US005116270A

United States Patent [19]

Aizawa et al.

[11] Patent Number: 5,116,270

[45] Date of Patent: May 26, 1992

[54] LUMINOUS POINTER AND MANUFACTURING METHOD THEREOF

[75] Inventors: Junichi Aizawa; Satoru Yamauchi, both of Tokyo, Japan

[73] Assignee: Seikosha Co., Ltd., Japan

[21] Appl. No.: 581,452

[22] Filed: Sep. 10, 1990

Related U.S. Application Data

[62] Division of Ser. No. 440,035, Nov. 21, 1989, abandoned.

[51] Int. Cl.[5] ..... H01J 9/22; H01J 9/26

[52] U.S. Cl. ..... 445/24; 427/66; 29/412; 445/52; 445/58

[58] Field of Search ..... 445/58, 24, 52; 427/66; 29/412

[56] References Cited

U.S. PATENT DOCUMENTS

| | | | |
|---|---|---|---|
| 2,922,912 | 1/1960 | Miller | 427/66 |
| 3,219,008 | 11/1965 | Harris et al. | 116/286 |
| 3,243,629 | 3/1966 | Levetan | 427/66 |
| 3,295,002 | 12/1966 | Amans | 427/66 |
| 3,378,715 | 4/1968 | Thornton | 427/66 |
| 3,868,756 | 3/1975 | Zumbach | 29/412 |
| 4,104,555 | 8/1978 | Fleming | 313/512 |
| 4,357,557 | 11/1982 | Inohara et al. | 313/509 |
| 4,708,914 | 11/1987 | Kamijo | 313/509 |
| 4,839,558 | 6/1989 | Mierzwinski | 313/512 |
| 4,882,517 | 11/1989 | Maruyama et al. | 313/509 |

FOREIGN PATENT DOCUMENTS

| | | | |
|---|---|---|---|
| 311181 | 5/1929 | United Kingdom | 29/148 |

*Primary Examiner*—Kurt Rowan
*Assistant Examiner*—Jeffrey T. Knapp
*Attorney, Agent, or Firm*—Bruce L. Adams; Van C. Wilks

[57] ABSTRACT

An insulating layer, a luminescent layer, a transparent electrode, base sheet with a transparent electrode formed thereon and a desiccant film are laminated in that order on the upper surface of a pointer body which also serves as a rear electrode. The upper surface of the dessiccant film is sealed with a moistureproof film. In producing a luminous pointer, these layers are laminated at a plurality of portions on the upper surface of a sheet which is to constitute pointer bodies, the pointer bodies are blanked along the outlines thereof by press working, and then the outside of the disiccant film is sealed with a moistureproof film. Alternatively, the outside of the desiccant film may be sealed with a moistureproof film before blanking the pointer bodies by press working.

10 Claims, 5 Drawing Sheets

LUMINOUS POINTER AND MANUFACTURING METHOD THEREOF

This is a divisional of application Ser. No. 440,035, filed Nov. 21, 1989, now abandoned.

BACKGROUND OF THE INVENTION

The present invention relates to a luminous pointer, having an electroluminescence element which emits light when an electric field is applied thereto, and a method of manufacturing such a luminous pointer.

In a conventional method of producing a luminous pointer having an electroluminescence element, an electroluminescence element prepared in advance is adhered to a pointer body. An electroluminescence element is composed of a transparent electrode which is formed on a transparent electrode base sheet. A luminescent layer is formed on the transparent electrode by applying luminescent particles obtained by adding an activator such as copper and chlorine to zinc sulfide with an organic binder such as cyanoethyl cellulose. A rear electrode is formed on the luminescent layer through an insulating layer of barium titanate or the like. Desiccant films sandwich the transparent electrode and the rear electrode, and moistureproof films of trifluoride ethylene polychloride or the like are provided on the outside of the desiccant films so as to constitute the top and bottom package films with the outer peripheral portions thereof being sealed by thermocompression bonding using a hot-melt adhesive. After sealing, the end portions are trimmed, thereby completing the process for producing an electroluminescence element.

Since the luminescent layer used for an electroluminescence element is deteriorated by even a slight water content, it is protected by the moistureproof films. The moistureproof films, however, do not completely prevent the ingress of water. To capture the slight amount of water which may pass through the moistureproof films, desiccant films are provided to, thereby improve the moistureproofness. The thickness of the electroluminescence element, therefore, inevitably increases, making it difficult to obtain a thin luminous pointer. In addition, it is necessary to have a sufficient width for the bonded portions of both moistureproof films in order to insure the adhesion of both films to prevent the ingress of water through the bonded portion. Therefore, it is difficult to obtain a luminous pointer having a narrow width. Furthermore, since the pointer body and the electroluminescence element are produced separately from each other and then bonded together, the production of a luminous pointer is complicated and time consuming. In particular it is difficult to adhere the bottom moistureproof film to the pointer body.

SUMMARY OF THE INVENTION

Accordingly, it is an object of the present invention to eliminate the above-described problems of the prior art and to provide a thin luminous pointer which has a narrow width and, hence, may be used as a hand of a timepiece or the like.

It is another object of the present invention to provide a manufacturing method which facilitates the production of such a luminous pointer.

To achieve these objects, a luminous pointer according to the present invention is produced by laminating an insulating layer, a luminescent layer, a transparent electrode base sheet with a transparent electrode formed thereon and a desiccant film in that order on the upper surface of a pointer body which also serves as a rear electrode, and sealing the upper surface of the desiccant film with a moistureproof film.

The pointer body may be made of a metal sheet, or a plastic sheet coated with a metal.

In one embodiment the upper surface of the luminous pointer flat, a recess is formed on the upper surface of the pointer body, and the insulating layer, luminescent layer, transparent electrode base sheet with a transparent electrode and desiccant film are laminated thereon in that order in the recess. In another embodiment, a pointer cover having an aperture which allows the upper surface of the moistureproof film to be exposed is provided on the upper surface of the pointer body, thereby making the upper surface of the luminous pointer flat.

A method of manufacturing a luminous pointer according to the present invention comprises the steps of laminating an insulating layer, a luminescent layer, a transparent electrode base sheet with a transparent electrode formed thereon and a desiccant film at a plurality of portions on the upper surface of a sheet which is to constitute pointer bodies, blanking the pointer bodies along the respective outlines thereof by press working, and sealing the outside of the desiccant film with a moistureproof film.

Alternatively, the outside of the desiccant film may be sealed with a moistureproof film before blanking the pointer bodies by press working.

The above and other objects, features and advantages of the present invention will become clear from the following description of the preferred embodiments thereof, taken in conjunction with the accompanying drawings.

BRIEF DESCRIPTION OF THE DRAWINGS

FIGS. 1 to 3 show an embodiment of a luminous pointer according to the present invention, wherein FIG. 1 is a plan view thereof;

FIG. 2 is a partially sectional right side elevational view thereof; and

FIG. 3 is an enlarged sectional view of the embodiment shown in FIG. 1, taken along the line A—A;

FIGS. 5 to 9 are explanatory views of an embodiment of a method of manufacturing a luminous pointer according to the present invention, wherein FIGS. 5 and 6 are perspective views thereof;

FIG. 7 is a partially cutaway plan view thereof;

FIG. 8 is a partially cutaway elevational view thereof; and

FIG. 9 is an enlarged sectional view of an embodiment shown in FIG. 8, taken along the line B—B.

DESCRIPTION OF THE PREFERRED EMBODIMENTS

Embodiments of the present invention will be explained with reference to the accompanying drawings.

Figure 1:
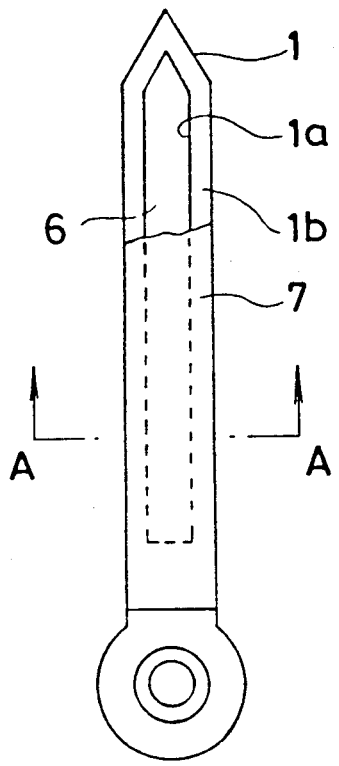
Figure 2:
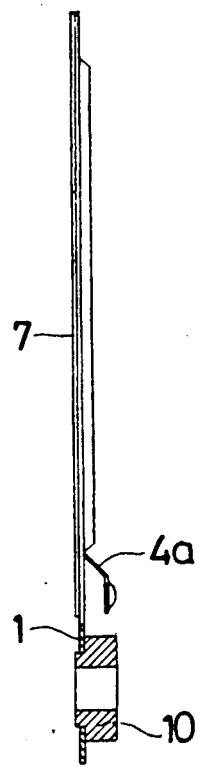
Figure 3:
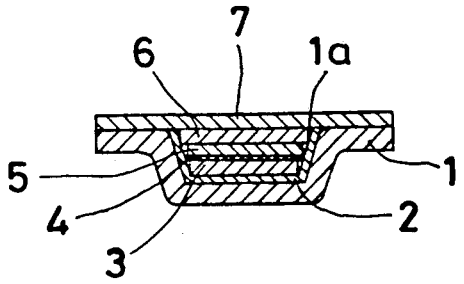

As shown in FIGS. 1 to 3, a pointer body 1 is made of a metal sheet, and a recess 1*a* is formed at the same time as blanking the pointer body 1 from the metal sheet along the outline by press working. In the recess 1*a*, an insulating layer 2, a luminescent layer 3, a transparent electrode base sheet 5 with a transparent electrode 4 formed thereon and a desiccant film 6 are laminated in that order. To the peripheral portion 1*b* of the pointer body 1 and the upper surface of the desiccant film 6, a transparent moistureproof film 7 is adhered so as to seal the layers from the insulating film 2 to the desiccant film 6 within the recess 1*a*. A take-out electrode 4*a*, which is taken out of one end portion of the recess 1*a*, is connected to the transparent electrode 4. A sleeve 10 is fixed to the center of the pointer body 1.

The metal pointer body 1 also serves as a rear electrode, when the luminescent layer 3 receives an electric field through the pointer body 1, namely, through the rear electrode and the take-out electrode 4*a*, it emits light which is reflected by the insulating layer 2.

The material comprising the pointer body 1 is not restricted to a metal sheet and a plastic sheet coated with a metal may also be used.

Figure 4:
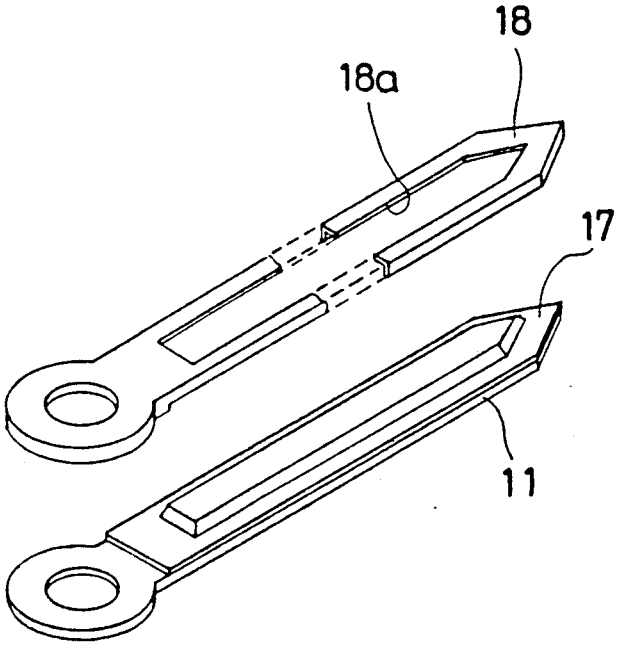
FIG. 4 is a partially cutaway exploded perspective view of another embodiment of the present invention.
Figure 5:
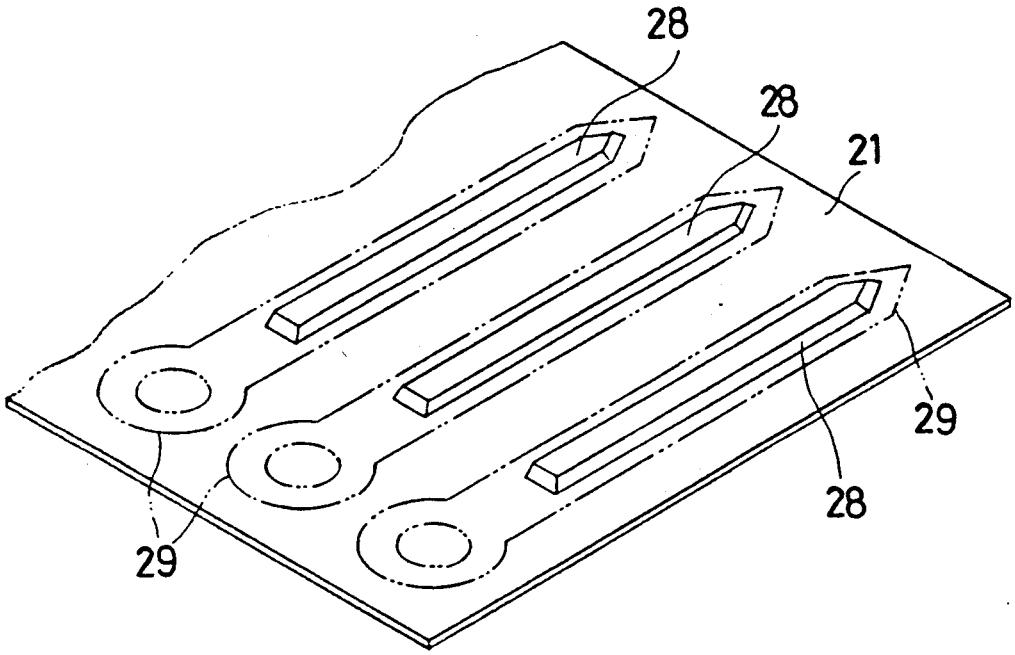

In another embodiment of a luminous pointer shown in FIG. 4, a pointer body 11 is not provided with a recess and the layers from the insulating layer to the desiccant film are formed on the upper surface of the planar pointer body 11 of the pointer body, 11 with the layers, is sealed with a moistureproof film 17. The upper surface of the luminous pointer produced in such a manner is covered with a pointer cover 18. The pointer cover 18 is provided with an aperture 18*a* from which the upper surface of the layers is visible through the moistureproof film 17.

Figure 6:
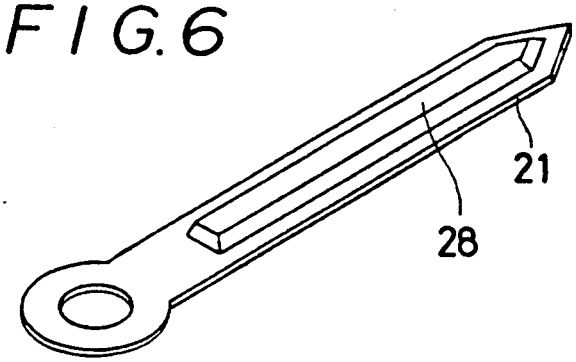
Figure 7:
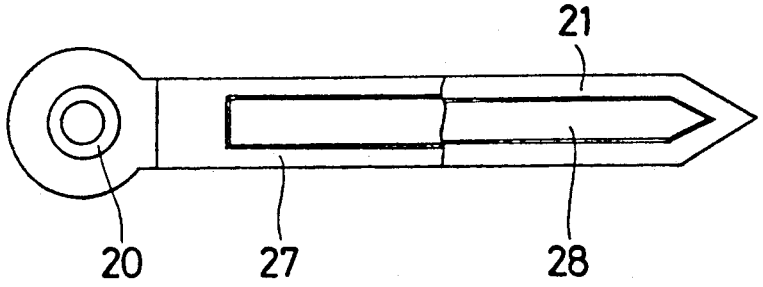
Figure 8:
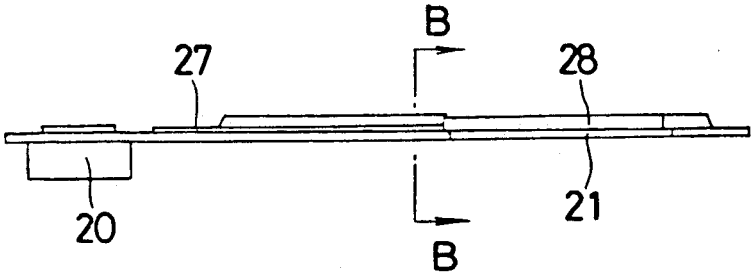
Figure 9:
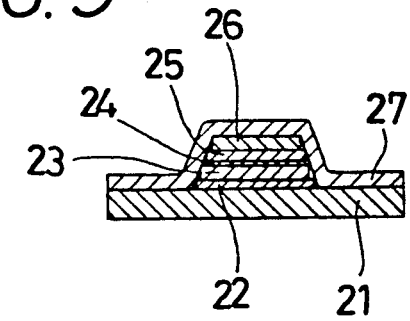

FIGS. 5 to 9 show an embodiment of a method of manufacturing a luminous pointer. On the upper surface of a metal sheet 21 which is to constitute pointer bodies, layers 28 (from an insulating layer to a desiccant film similar to the above-described layers) are first formed at a plurality of portions with predetermined intervals therebetween. The pointer bodies 21 are then blanked along the outlines 29 thereof by press working, as shown in FIG. 6. A moistureproof film 27 is thereafter adhered to the upper surfaces of the pointer body 21 and the layers 28, and a sleeve 20 is finally fixed to the center of rotation of the pointer body 21, as shown in FIGS. 7 and 8. As is clear from the section of the luminous pointer shown in FIG. 9, the layers 28 includes an insulating layer 22, a luminescent layer 23, a transparent electrode base 25 with a transparent electrode 24 formed thereon and the desiccant film 26 laminated in that order which are formed on the upper surface of the pointer body 21, and the upper surface thereof is sealed with the moistureproof film 27.

Figure 10:
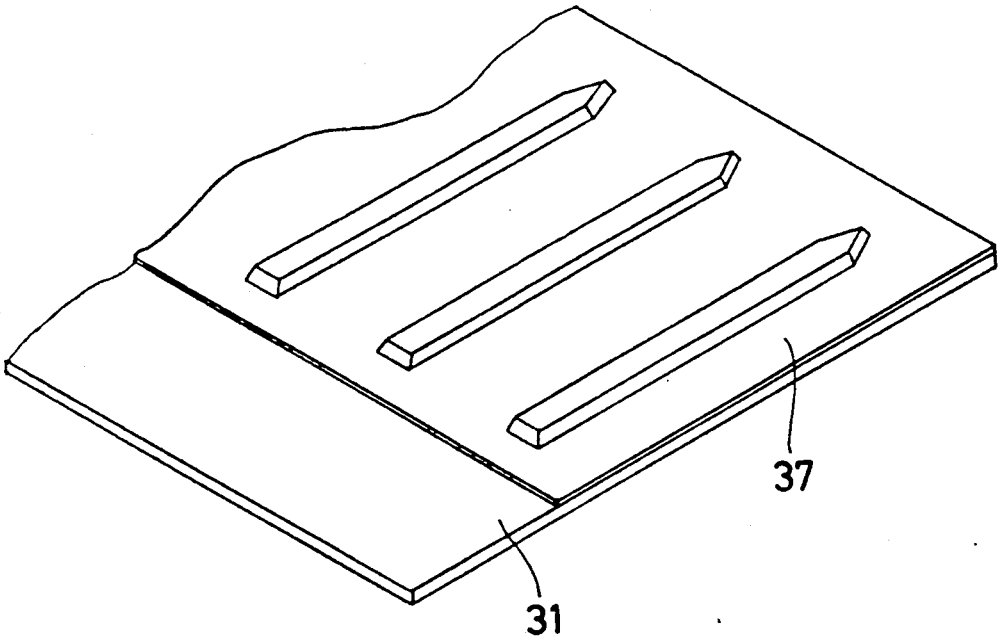
FIG. 10 is a perspective view of another embodiment of a method of manufacturing a luminous pointer according to the present invention.

FIG. 10 is an explanatory view of another embodiment of a method of manufacturing a luminous pointer according to the present invention. On the upper surface of a metal sheet 31 which is to constitute pointer bodies, layers from an insulating layer to a desiccant film are first formed at a plurality of portions with predetermined intervals therebetween in the same way as in the embodiment shown in FIG. 5. Then a moistureproof film 37 is adhered to the upper surfaces of pointer bodies 31 and the layers. Finally, the pointer bodies 31 are blanked along the outlines thereof by press working.

Since a luminous pointer according to the present invention having the above-described structure is produced by laminating the layers, including a luminous layer, directly on the upper surface of a pointer body which also serves as a rear electrode, and a desiccant film and a moistureproof film are provided only on the upper surface, reduction of the thickness of a luminous pointer is achieved. In addition, a reduction in the width of a luminous pointer is also provided by directly adhering the moistureproof film to the upper surface of the pointer body. Thus, the luminous pointer of the present invention can be used as a hand of a timepiece or the like.

It is also possible to make the upper surface of a luminous pointer flat by forming the above-described layers within the recess formed on the pointer body.

Furthermore, by providing a pointer cover, it is possible to make the upper surface of a luminous pointer flat, from the luminous portion into a desired shape, provide a distinct outline and cover a lead wire from exposure, thereby providing the luminous pointer with an esthetic external appearance.

In addition, the pointer body also serves as a rear electrode enhance the reliability of moistureproofness and prolong the life of the pointer. Moreover, since the desiccant film and the moistureproof film on the other side, which are essential in the prior art, are dispensed with, is reduced the amount of expensive moistureproof film used is reduced and, hence, a reduction in the production cost is realized.

According to a method of manufacturing a luminous pointer of the present invention, since the layers including a luminous layer are formed at a plurality of portions of a sheet at the same time and the respective luminous pointers are blanked by press working, manufacturing is simplified.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. A method of manufacturing luminous pointers, comprising the steps of: laminating an insulating layer at a plurality of portions at the same time on the upper surface of a sheet which is to constitute pointer bodies; laminating a luminescent layer upon said insulating layer at said portions at the same time; laminating a transparent electrode base sheet with a transparent electrode formed thereon upon said luminescent layer at said portions at the same time; laminating a desiccant film upon said transparent electrode base sheet at said portions at the same time; blanking the pointer bodies along outlines thereof by press working; and subsequently sealing the outside of said desiccant film with a moistureproof film.

2. A method of manufacturing luminous pointers, comprising the steps of: laminating an insulating layer at a plurality of portions at the same time on the upper surface of a sheet which is to constitute pointer bodies; laminating a luminescent layer upon said insulating layer at said portions at the same time; laminating a transparent electrode base sheet with a transparent electrode formed thereon upon said luminescent layer at said portions at the same time; laminating a desiccant film upon said transparent electrode base sheet at said portions at the same time; sealing the outside of said desiccant film with a moistureproof film; and subsequently blanking the pointer bodies along outlines thereof by press working.

3. A method of manufacturing luminous members comprising the steps of: providing a substrate from which the bodies of the luminous members are to be formed; forming at the same time a plurality of insulating layer portions on one surface of the substrate, the insulating layer portions being formed at predefined portions of the substrate corresponding to respective ones of the luminous member bodies; forming at the same time a luminescent layer on the respective insulating layer portions; forming at the same time a transparent electrode on the luminescent layer; blanking the substrate along outlines of the luminous member bodies by press working to produce a plurality of individual luminous members; and sealing the luminous members with a moistureproof film.

4. A method of manufacturing luminous members according to claim 3, wherein the step of sealing the luminous members is performed before the step of blanking.

5. A method of manufacturing luminous members according to claim 4; further comprising a step of forming a desiccant layer on the transparent electrode before the step of sealing the luminous members.

6. A method of manufacturing luminous members according to claim 3; wherein the step of blanking is performed before the step of sealing the luminous members.

7. A method of manufacturing luminous members according to claim 11; further comprising a step of forming a desiccant layer on the transparent electrode before the step of sealing the luminous members.

8. A method of manufacturing luminous members according to claim 3; wherein the substrate is comprised of a metal.

9. A method of manufacturing luminous member according to claim 3; wherein the substrate is a metal-coated plastic.

10. A method of manufacturing luminous members according to claim 3; wherein the luminous members have a pointer shape.

* * * * *